United States Patent [19]

Allen

[11] 4,232,576

[45] Nov. 11, 1980

[54] DEVICE FOR SEVERING A CONTINUOUS AXIALLY MOVING ROD-LIKE MEMBER INTO SEPARATE ELEMENTS

[75] Inventor: Roger A. Allen, Prestwood, England

[73] Assignee: The Wiggins Teape Group Limited, Basingstoke, England

[21] Appl. No.: 972,897

[22] Filed: Dec. 26, 1978

[30] Foreign Application Priority Data

Dec. 28, 1977 [GB] United Kingdom ..... 54024/77

[51] Int. Cl.[3] ..... A24C 5/28

[52] U.S. Cl. ..... 83/309; 83/310; 83/324; 83/542

[58] Field of Search ..... 83/309, 310, 324, 350, 83/355, 593, 542

[56] References Cited

U.S. PATENT DOCUMENTS

| | | | |
|---|---|---|---|
| 1,786,519 | 12/1930 | Chandler | 83/593 X |
| 2,109,146 | 2/1938 | Garling | 83/309 |
| 3,590,678 | 7/1971 | Hasten | 83/593 X |

FOREIGN PATENT DOCUMENTS

| | | | |
|---|---|---|---|
| 171563 | 12/1951 | Austria | 83/593 |

*Primary Examiner*—J. M. Meister

*Attorney, Agent, or Firm*—Shlesinger, Arkwright, Garvey & Dinsmore

[57] ABSTRACT

A device for severing a continuous rod-like member into separate elements during axial movement along a predetermined path through a severance zone comprising a ledger for engaging and maintaining said member in said path during its passage though said zone, means for causing a cutting knife to move along an endless course substantially at right angles to said path, and said course intersecting transversely with said path to sever the member and means for causing the knife to move at a greater speed while it is travelling across said path than in other parts of its movement.

7 Claims, 3 Drawing Figures

DEVICE FOR SEVERING A CONTINUOUS AXIALLY MOVING ROD-LIKE MEMBER INTO SEPARATE ELEMENTS

This invention relates to a device for severing a continuous rod-like member into separate elements.

It is known to pass a continuous rod-like element through a sleeve-like ledger former with a transverse guide slot for co-operation with a rotary knife. The knife is timed in relation to the rod speed so as to pass through the guide slot during each rotation and sever the member into a series of relatively short elements. In the manufacture of cigarettes for example these elements are in the region of 60 to 70 mm long corresponding to the length of the cigarette.

Because of the continual axial movement of the member, it is necessary to provide for corresponding axial movement of the ledger and knife during severance in order to effect a clean transverse cut. For this purpose, the ledger is reciprocated axially, and the knife is mounted on an appropriately set universal joint so as to provide for corresponding limited axial movement during engagement with the ledger.

Where, as in the case of cigarettes, the severed elements are required to be of relatively short lengths, an arrangement such as that above described is adequate. But where the elements are required to be of substantially greater length (for example in the case of an 8 mm diameter rod, in excess of about 300 mm), problems arise. Due to the greater length of the element to be cut, the interval between cuts will be much greater and it is therefore necessary to slow the knife down in order to maintain the appropriate frequency of cutting. This leads to two difficulties. First, the knife will be required to make a substantial axial movement during its period of engagement with the ledger, and this movement is much greater than can be accommodated by the use of the universal joint works in conjunction with a ledger. Secondly, the knife only works effectively when used at a speed substantially higher than that determined by the frequency of cut required.

It is among the objects of the present invention to provide a severance device whereby the above described difficulties can be substantially overcome, in the severance of longer elements, and which, in the case of shorter elements, may obviate the necessity for providing a universal joint.

According to the present invention a device for severing a continuous rod-like member into separate elements during axial movement along a predetermined path through a severance zone comprises a ledger for engaging and maintaining said member in said path during its passage through said zone, means for causing a cutting knife to move along an endless course substantially at right angles to said path, and said course intersecting transversely with said path to sever the member and means for causing the knife to move at a greater speed whilst it is travelling across said path than in other parts of its movement.

Thus, with this arrangement the knife is not required to make a substantial axial movement whilst passing across the path of the member because its increased speed can cause it to pass through the cutting zone rapidly and it can be used at an effective speed. It therefore allows a longer length of member to pass across the ledger than is normal but cuts through the member rapidly when required.

Preferably said knife is connected to drive means through a variable speed transmission. The term variable speed transmission is not intended to include a transmission which can be manually or automatically adjusted to drive at different speeds, for example, a gear box, but it is intended to mean a transmission the output speed of which alters cyclically and/or continuously.

With this arrangement the knife may comprise a blade mounted for rotation about an axis and the variable speed transmission may include a quick return motion device such as a Whitworth quick return motion or any other suitable type of device such as a pair of four bar linkages arranged in tandem and appropriately dimensioned.

With motions of this kind the rotary knife blade can be caused to rotate at a set or varying speed during most of its angular movement but as it passes across the path in the severance zone it is caused to travel at a higher speed of rotation.

This kind of apparatus therefore again overcomes the difficulties referred to earlier by causing the knife to move quickly through the severance zone so that it is working at high speed and thus effectively, the amount of axial movement required is reduced to a minimum and, in certain circumstances, can be dispensed with, and it also enables the rod-like member to move over greater distances than hitherto between cuts.

If desired, however, means for causing the knife to simultaneously travel along said path as it passes across it can be included and this can be achieved by arranging for the knife to be carried on a universal joint.

The ledger can be provided with guide means which guide said knife as it passes across said path and with this arrangement the guide means may comprise a slot in the ledger transverse to the direction of movement of said member in said path and through which the knife passes.

With this arrangement the blade may be arranged to be flexible to the direction of movement of the member along said path so that it can be distorted by the ledger as it passes through the slot.

In a convenient arrangement the ledger comprises a rotary element having an annular groove which acts to engage and maintain said member in said path through the severance zone and with this arrangement the slot is arranged to extend across the groove.

If desired means may be included for blowing air into the slot to remove waste which may tend to build up in it due to the cutting action.

The invention can be performed in many ways but one embodiment will now be described by way of example and with reference to the accompanyinng drawings in which.

Figure 1:
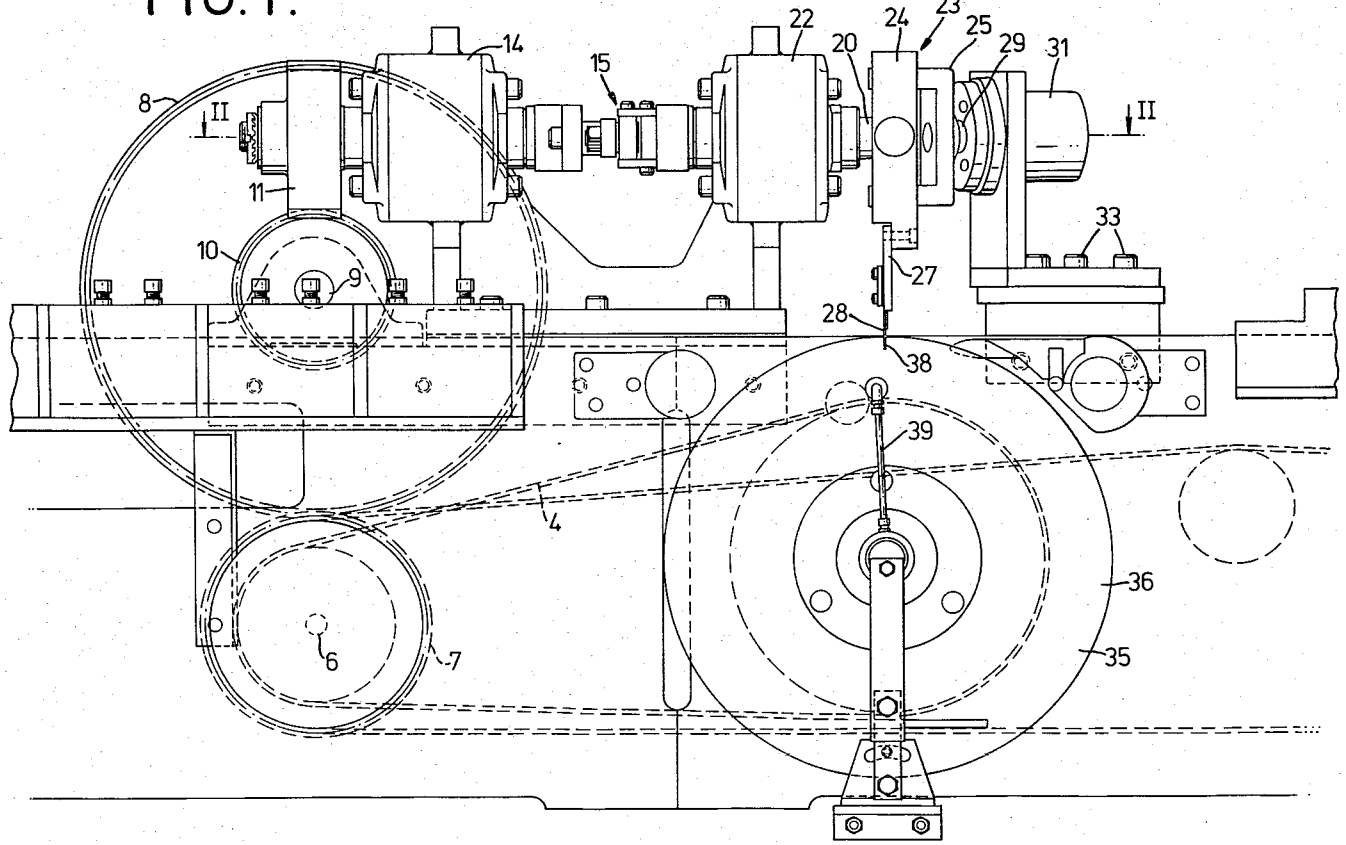
FIG. 1 is a side elevation of a device incorporating the invention for severing a continuous rod of fibrous material.
Figure 2:
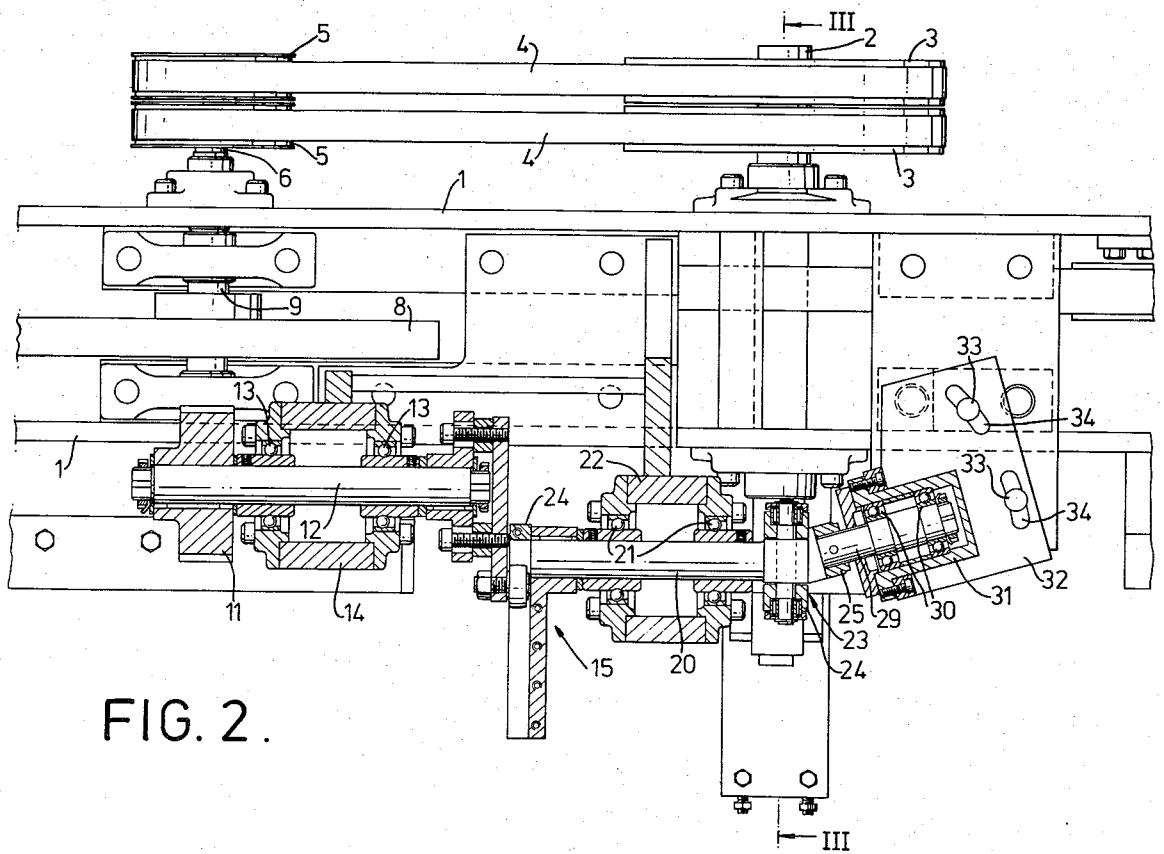
FIG. 2 is a plan view in cross section on the line II—II of FIG. 1.

The device shown in the drawings is intended to sever a continuous rod of fibrous material which may, for example, be used as a filter element for cigarettes. This material may be very soft and lacking in cohesion and it is therefore essential that it is severed quickly and effectively, otherwise bending and breakage is likely to occur. The material is cut into lengths of about 1 meter which are then passed on to further processing apparatus.

As shown in the drawings the device comprises a supporting frame indicated by reference numeral 1. Mounted within the frame is a drive shaft 6 driven by power operated means (not shown). This drive shaft carriers drive pulleys 5 which drive belts 4 to convey motion to driven pulleys 3 carried on a driven shaft 2 which is also supported within the frame 1. The shaft 2 has keyed thereto a rotary ledger 36 to be described hereunder. The drive shaft 6 carries a spur gear 7 which drives a gear 8 carried on a shaft 9 supported in the frame. Also mounted on the shaft 9 is a helical gear 10 which drives a co-operating gear 11 carried on a drive shaft 12. This drive shaft is carried in bearings 13 in a housing 14 and is connected at one end to one part of a Whitworth quick return motion indicated generally by reference numeral 15. The off-set final drive shaft 20 from the motion is carried in bearings 21 in a housing 22 supported by the frame 1 and is connected at its other end to a universal joint indicated generally by reference numeral 23. This universal joint comprises a main body portion 24 pivoted to the shaft 20 and a fork end 25 which is pivoted by pins 26 to the main body portion, as is most clearly shown in FIG. 3. The main body portion 24 is provided with a blade holder 27 in which is carried a cutting blade 28. The blade is flexible in a sideways direction and has a blade stiffener arranged alongside it.

The fork end 25 is connected to a bearing shaft 29 housed in bearings 30 in an end mounting 31 carried on a bracket 32 which is secured to the frame 1 by means of screws 33. These screws are arranged in slots 34 so that the angle between shaft 20 and shaft 29 of the universal joint can be adjusted.

The drive arrangements are such that rotation of the main drive shaft 6 causes rotation of the shaft 12 at a constant speed. This constant speed is converted into a variable speed by the Whitworth quick return motion 15. This motion is of well known kind and will not be described in detail but its effect is to cause the shaft 20 to rotate until a certain point is reached when its angular velocity is increased over a short angular distance. The motion is arranged so that the blade 28 therefore rotates over most of its rotary movement at one speed but is then speeded up as it passes through the lower part of its rotary motion. Due to the fact that the blade is carried on the universal joint it rotates in a plane at an angle to the axis of the rod of fibrous material to be cut, as determined by the setting of screws 33 in the slots 34; as a result when the blade passes through the lower part ot its arc of movement it shifts axially with the rod.

Figure 3:
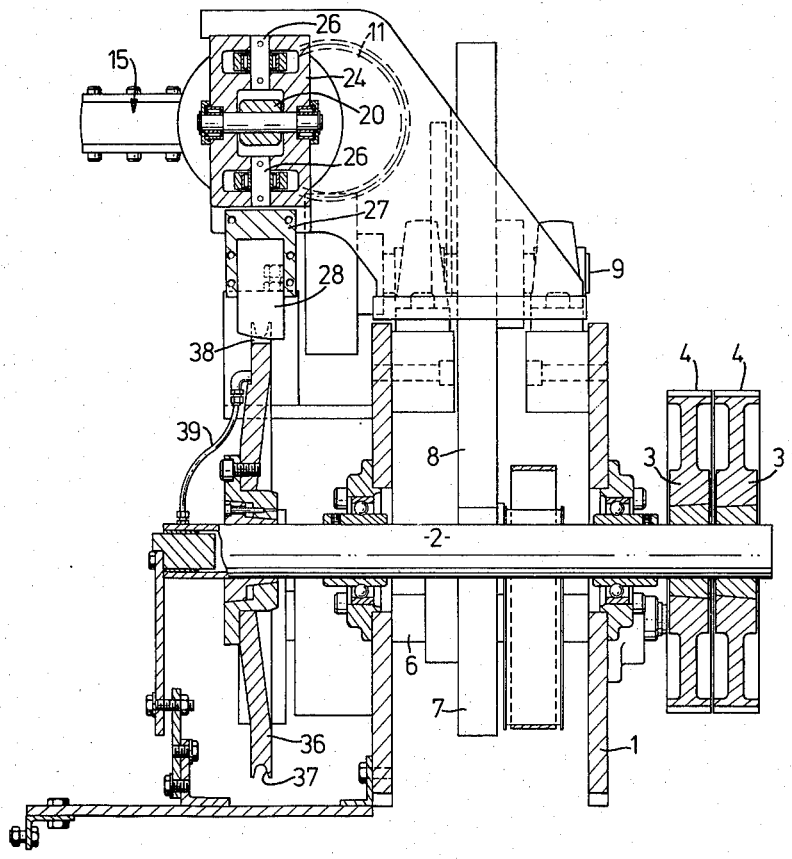
FIG. 3 is a cross section end elevation on the line III—III of FIG. 1.

Mounted on the drive shaft 2 is a rotary ledger 35, which is formed from a dished disc 36, the outer periphery of which is provided with an annular groove 37, as best shown in FIG. 3. This ledger is caused to rotate with the shaft 2 and its axis of rotation is arranged so that the line of movement of the blade is substantially in line with it. The ledger disc 36 is provided with a thin slot 38 which is only slightly larger than the thickness of the blade 28, this slot extending deeper than the groove 37.

Conveyor means, not shown, are provided for feeding a length of rod-like fibrous material up to the upper edge of the ledger and for then removing the cut material from it, this guide means may be in the form of a moving conveyor.

The various gears and drives are arranged so that the rod-like material is fed to the ledger at a constant rate of movement and as it leaves the guide means (not shown) and enters the groove on the ledger it comes within a severance zone. The rotating ledger supports the soft material as it passes through the severance zone and the speed of movement, which is compatible with the speed of rotation of the ledger, is arranged in relation to the speed of rotation of the shaft 20 so that the knife rotates through its endless course and lines up with and passes through the slot 38 each time the slot rotates to provide the desired length of material. It will be appreciated that the length of material does not necessarily correspond to the length of the periphery of the groove 37 in the ledger due to slippage and other reasons. If the knife rotated at a constant speed so that it described one revolution corresponding with one revolution of the ledger its speed of cut through the path of the material passing through the severance zone would be relatively slow and this would tend to cause tearing of the member which is to be cut. Due to the quick return motion however speed of rotation of the knife varies so that it passes round most of its angular movement and lines with the slot 30 in the ledger but as it passes through the slot the quick return motion causes its angular velocity to be considerably increased and it therefore moves through the groove 37 at much greater speed thus ensuring a clean cut and minimal time of engagment with the slot 38.

The slot 38 is however aligned with the axis of rotation of the ledger and the point of entry of the knife 28 is arranged so that it enters the slot 38. The flexible nature of the knife 28 allows it to distort slightly as it passes through to ensure that the cut through the slot is normal to the direction of movement of the member.

The slot is of course moving angularly whilst the cut is taking place but a similar movement is also taking place with the blade due to its being mounted on a universal joint. The amounts of movement are compatible and the distortion of the blade therefore tends to be restricted merely to the alignment movement.

A pipe 39 is provided which is connected to a source of air pressure (not shown) to allow air under pressure to be blown into the slot through an opening (not shown) to blow out any swarf which might gather.

In the arrangement described above it is necessary for there to be close support for the member to be cut and for this reason the blade is arranged to pass closely through the slot 38 which therefore acts as a guide means. If stronger material is used however these guide means may not be necessary and it may be possible to provide a much wider slot, especially if it is not necessary to cut accurately at right angles to the direction of movement of the member.

From the above it will be appreciated that the device overcomes the difficulties of relatively long elements at high speed.

If it is desired to cut short elements, for example those in the region of 60 to 70 mm the universal joint may be deleted and the blade merely mounted on a support on the end of the shaft 20. With short length material where the speed of movement of the rod-like member is to be the same the rotating cutter will have to rotate at much higher speed. Due to this much increased speed and due to the fact that whilst it severs the member it is going at an even higher speed it may not be necessary to provide the axial movement achieved by the universal joint. Although in the embodiment described above a rotary ledger is employed other means of supporting the rod-like member could be used, for example a reciprocating ledger could be incorporated or, if there was to be no axial movement of the blade a stationery trough could act to support the rod-like member to be cut. In the arrangement described above the rotary ledger is particularly effective because it provides assistance to the forward motion of the very soft material.

As described above the device is incorporated in apparatus for making cigarette filters, but it could of course be effectively used in many other applications where it is necessary for cutting a continuous rod like member of material which can be cut with a knife for example a tobacco column or cigarette component.

What we claim is:

1. A device for severing a continuous rod-like member into separate elements during axial movement of the rod-like member along a predetermined path through a severance zone, comprising:

a ledger disc having a radially facing annular peripheral groove and a radial knife guide slot extending inwardly from the periphery of said ledger disc so as to intersect said groove, said ledger disc being rotatably mounted in a substantially vertical plane beneath said path for supporting said rod-like member substantially tangentially in said annular groove during passage through the severance zone;

a flexible cutting knife slidable cooperable with said knife guide slot in said ledger disc;

knife support means including a universal joint mounted adjacent to the severance zone and movable for causing said knife to follow an endless course intersecting said path at said annular groove with a component of motion along said path in the direction of movement of said rod-like member;

means for rotating said ledger disc at a predetermined speed; and, means for driving said knife support means in synchronism with said ledger disc to cause said knife to pass thorugh said knife guide slot when in the severance zone and at a greater speed than the speed maintained during the remainder of its movement.

2. The device of claim 1 wherein said knife support driving means includes a variable speed transmission.

3. The device of claim 2 wherein said variable speed transmission comprises a quick return motion device.

4. The device of claim 3 wherein said quick return motion device is a Whitworth quick return motion.

5. The device of claim 3 wherein said quick return motion device includes a pair of appropriately dimensioned four bar linkages arranged in tandem.

6. The device of claim 1, 2, 3, 4, or 5 and including means for injecting pressurized air into said knife guide slot after said knife guide slot has moved out of the severance zone.

7. A device for severing a continuous rod-like member into separate elements during axial movement of the rod-like member along a predetermined path through a severance zone, comprising:

a ledger disc having a radially facing annular peripheral groove and a radial knife guide slot extending inwardly from the periphery of said ledger disc so as to intersect said groove, said ledger disc being rotatably mounted in a substantially vertical plane beneath said path for supporting said rod-like member substantially tangentially in said annular groove during passage through the severance zone;

a flexible cutting knife slidable cooperable with said knife guide slot in said ledger disc;

knife support means including a universal joint mounted adjacent to the severance zone and movable for causing said knife to follow an endless course intersecting said path at said annular groove with a component of motion along said path in the direction of movement of said rod-like member;

means for rotating said ledger disc at a predetermined speed; and, means for driving said knife support means in synchronism with said ledger disc to cause said knife to pass through said knife guide slot when in the severance zone, said driving means including means for causing said knife to pass through said guide slot at a greater speed than the speed maintained during the remainder of its movement.

* * * * *